US007949281B2

(12) United States Patent
Muraishi et al.

(10) Patent No.: US 7,949,281 B2
(45) Date of Patent: May 24, 2011

(54) PROCESS CARTRIDGE AND IMAGE FORMING APPARATUS FOR EFFECTIVELY CLEANING A CHARGING ROLLER AT PREDETERMINED INTERVALS

(75) Inventors: Takaya Muraishi, Kawasaki (JP); Atsushi Sampe, Yokohama (JP); Takeshi Shintani, Kawasaki (JP); Ken Amemiya, Tokyo (JP); Yoshiki Hozumi, Sagamihara (JP); Hiroshi Ono, Tokyo (JP)

(73) Assignee: Ricoh Company Limited, Tokyo (JP)

( * ) Notice: Subject to any disclaimer, the term of this patent is extended or adjusted under 35 U.S.C. 154(b) by 761 days.

(21) Appl. No.: 11/935,106

(22) Filed: Nov. 5, 2007

(65) Prior Publication Data

US 2008/0124117 A1 May 29, 2008

(30) Foreign Application Priority Data

Nov. 6, 2006 (JP) ..... 2006-300700

(51) Int. Cl.
*G03G 15/02* (2006.01)

(52) U.S. Cl. ..... 399/100

(58) Field of Classification Search ..... 399/43, 399/100, 176
See application file for complete search history.

(56) References Cited

U.S. PATENT DOCUMENTS 5,638,158 A 6/1997 Sanpe et al.
5,678,134 A * 10/1997 Miki et al. ..... 399/71
5,878,317 A 3/1999 Masuda et al.
5,978,616 A * 11/1999 Shin ..... 399/100
6,088,551 A 7/2000 Satoh et al.
6,628,912 B2 9/2003 Amemiya et al.
6,757,505 B2 6/2004 Amemiya et al.
6,807,390 B2 10/2004 Suda et al.
6,873,809 B2 3/2005 Amemiya et al.
7,062,194 B2 6/2006 Yanagida et al.
7,139,504 B2 11/2006 Yanagida et al.
7,155,146 B2 12/2006 Kosuge et al.
7,218,877 B2 5/2007 Yanagida et al.
7,263,308 B2 8/2007 Harada et al.
7,266,324 B2 9/2007 Yanagida et al.
7,715,750 B2 * 5/2010 Kagawa ..... 399/100
2005/0169663 A1 8/2005 Shintani et al.
2005/0191081 A1 9/2005 Muraishi et al.
2005/0271420 A1 12/2005 Arai et al.

(Continued)

FOREIGN PATENT DOCUMENTS

JP 2003-66807 3/2003

(Continued)

OTHER PUBLICATIONS

U.S. Appl. No. 12/201,396, filed Aug. 29, 2008, Kosuge, et al.

*Primary Examiner* — William J Royer
(74) *Attorney, Agent, or Firm* — Oblon, Spivak, McClelland, Maier & Neustadt, L.L.P.

(57) ABSTRACT

An image forming apparatus includes a charging roller that continuously rotates and uniformly charges a photoconductor for forming an electrostatic latent image thereon, a cleaning roller that contacts a peripheral surface of the charging roller and cleans the charging roller while being driven by rotation of the charging roller, wherein a peripheral surface of the cleaning roller is formed of a melamine resin foam, and a cleaning roller shifting unit that causes the cleaning roller to contact the charging roller for a predetermined time at predetermined intervals of image formation while movably holding the cleaning roller.

18 Claims, 2 Drawing Sheets

U.S. PATENT DOCUMENTS

| | | | |
|---|---|---|---|
| 2006/0008296 | A1 | 1/2006 | Sampe et al. |
| 2006/0018680 | A1 | 1/2006 | Hosokawa et al. |
| 2006/0078353 | A1 | 4/2006 | Kosuge et al. |
| 2006/0115286 | A1 | 6/2006 | Uchitani et al. |
| 2006/0115292 | A1 | 6/2006 | Sampe et al. |
| 2006/0133834 | A1 | 6/2006 | Yoneda et al. |
| 2007/0059035 | A1 | 3/2007 | Yoshino et al. |
| 2007/0104513 | A1 | 5/2007 | Kosuge et al. |

FOREIGN PATENT DOCUMENTS

| | | |
|---|---|---|
| JP | 2003-280264 | 10/2003 |
| JP | 2004-102182 | 4/2004 |
| JP | 2005-70750 | 3/2005 |
| JP | 2005-221981 | 8/2005 |
| JP | 2005-227411 | 8/2005 |
| JP | 2006-3593 | 1/2006 |
| JP | 2006-17882 | 1/2006 |

* cited by examiner

PROCESS CARTRIDGE AND IMAGE FORMING APPARATUS FOR EFFECTIVELY CLEANING A CHARGING ROLLER AT PREDETERMINED INTERVALS

CROSS-REFERENCE TO RELATED APPLICATIONS

The present patent application claims priority under 35 U.S.C. §119 from Japanese Patent Application No. 2006-300700, filed on Nov. 6, 2006 in the Japanese Patent Office, the entire contents and disclosure of which are hereby incorporated by reference herein.

BACKGROUND OF THE INVENTION

1. Field of the Invention

Preferred embodiments of the present invention generally relate to an image forming apparatus for effectively cleaning a charging roller, and more particularly, to a cleaning roller shifting unit provided in the image forming apparatus that causes a cleaning roller to contact the charging roller for a predetermined time during a non-operation of image formation at predetermined intervals.

2. Discussion of the Related Art

In an image forming apparatus that employs an electrophotographic method to form an image, a photoconductor uniformly charged by a charging member in advance is irradiated with reflected light from a document such that an electrostatic latent image is formed thereon. Then, toner supplied from a developing device is applied to the electrostatic latent image such that a toner image is formed on the photoconductor. The toner image is transferred and fixed onto a sheet of transfer paper to form an image.

In such an image forming apparatus, since the charging member is disposed in contact with or in close proximity to the photoconductor, foreign material such as residual toner or paper particles remaining on the photoconductor are prone to attach to a peripheral surface of the charging member. Such foreign material attached to a peripheral surface of a charging member prevents the charging member from uniformly charging the photoconductor and results in image quality deterioration. Therefore, a variety of techniques have been proposed to remove foreign material attached to a charging member.

For example, a known technique has been proposed for removing foreign material attached to a peripheral surface of a charging roller by employing a cleaning roller that collects the foreign material on the peripheral surface and a separation mechanism that causes the cleaning roller to separate from the charging roller.

However, such a technique has a drawback in that frequent cleaning may shorten a life of a cleaning roller even though the technique sufficiently cleans a charging member and satisfactorily maintains performance of the charging member for a certain term. According to the technique, the cleaning roller cleans the charging roller at every image formation even though the charging roller does not require cleaning. The frequent cleaning may also cause waste and unfavorably affect the charging roller.

SUMMARY OF THE INVENTION

The present invention describes a novel process cartridge. In one preferred embodiment, a process cartridge includes a charging roller configured to continuously rotate and uniformly charge a photoconductor which forms an electrostatic latent image thereon, a cleaning roller configured to contact a peripheral surface of the charging roller and clean the charging roller while being driven by rotation of the charging roller, and a cleaning roller shifting unit configured to cause the cleaning roller to contact the charging roller for a predetermined time at predetermined intervals of image formation while holding the cleaning roller movably. A peripheral surface of the cleaning roller is formed of a melamine resin foam.

The present invention further describes a novel image forming apparatus. In one preferred embodiment, an image forming apparatus includes a charging roller configured to continuously rotate and uniformly charge a photoconductor which forms an electrostatic latent image thereon, a cleaning roller configured to contact a peripheral surface of the charging roller and clean the charging roller while being driven by rotation of the charging roller, and a cleaning roller shifting unit configured to cause the cleaning roller to contact the charging roller for a predetermined time at predetermined intervals of image formation while holding the cleaning roller movably. A peripheral surface of the cleaning roller is formed of a melamine resin foam.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
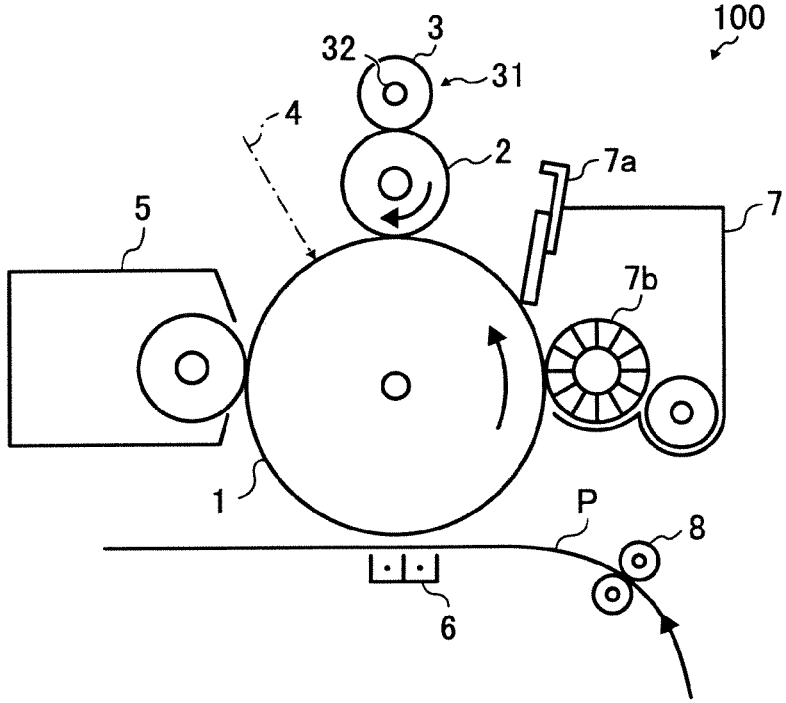
FIG. 1 is a schematic front view showing a configuration of an image forming unit of an image forming apparatus according to a preferred embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner.

Referring now to the drawings, wherein like reference numerals designate identical or corresponding parts throughout the several views, preferred embodiments of the present invention are described. It should be noted that an image forming apparatus according to a preferred embodiment of the present invention may be an electrophotographic image forming apparatus such as a printer, facsimile, copier, or the like.

Figure 2:
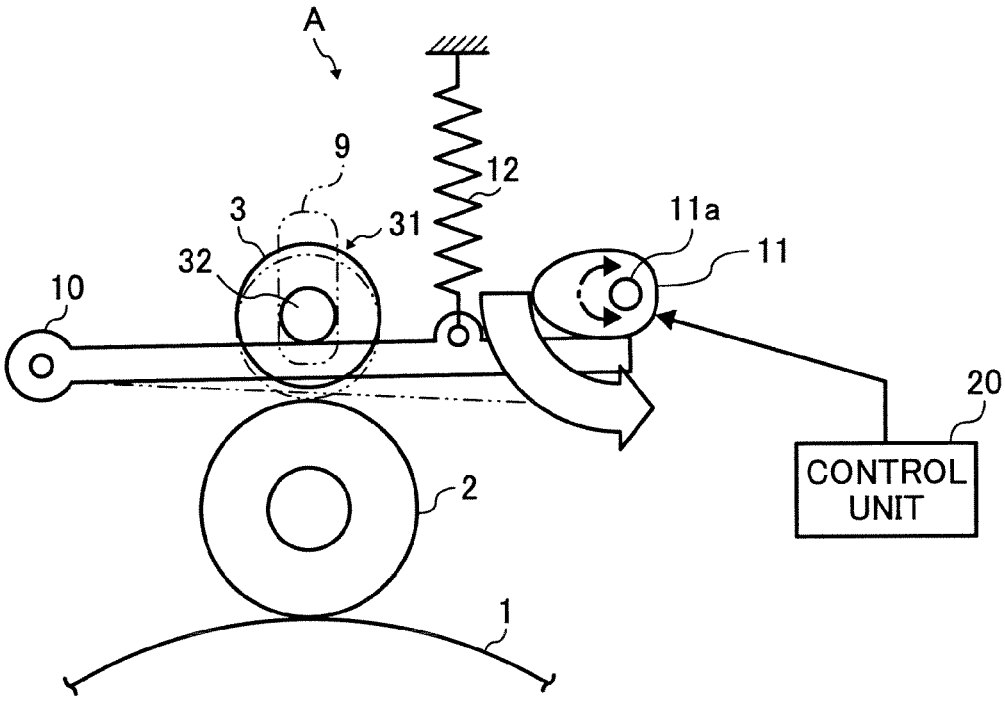
FIG. 2 is a schematic front view showing a configuration of a cleaning roller shifting unit of the image forming apparatus shown in FIG. 1.

Referring to FIGS. 1 and 2, a description is given of an image forming apparatus according to a preferred embodiment of the present invention.

FIG. 1 shows schematically a configuration of an image forming unit 100 of the image forming apparatus. FIG. 2 is a schematic front view showing a configuration of a cleaning roller shifting unit of the image forming apparatus shown in FIG. 1.

In FIG. 1, the image forming unit 100 includes a photoconductor 1, a charging roller 2, a cleaning roller 3 for cleaning the charging roller 2 by contact therewith, a writing unit 4, a developing device 5, a transfer device 6, and a cleaning device 7. The charging roller 2, the developing device 5, the transfer device 6, and the cleaning device 7 are arranged around the periphery of the photoconductor 1. The transfer device 6 transfers a toner image formed on the photoconductor 1 to a sheet of transfer paper P fed to the transfer device 6 by registration rollers 8 at a predetermined time. A fixation device disposed on a downstream side of a paper conveyance path fixes the transferred toner image.

The charging roller 2 is made of rubber or resin and commonly known as a roller for uniformly charging the photoconductor 1 for forming an electrostatic latent image. A frame, or the like, not shown, holds the charging roller 2 in a rotatable manner, and a drive mechanism, not shown, rotates the charging roller 2. The charging roller 2 is also disposed such that an infinitesimal space (for example, a gap of approximately 50 μm) is formed between the photoconductor 1 and the charging roller 2 and an axial center of the charging roller 2 is positioned on a center line of the photoconductor 1 in a vertical direction. In FIG. 1, the photoconductor 1 rotates in a counterclockwise direction (the charging roller 2 rotates in a clockwise direction) when an image is formed. Alternatively, the charging roller 2 may be disposed so as to contact the photoconductor 1.

The cleaning device 7 includes a cleaning blade 7*a* and a fur brush 7*b*. The cleaning blade 7*a* is plate-shaped so as to scrape foreign material such as toner remaining on the photoconductor 1. The fur brush 7*b* is rotatable and has a substantially columnar shape so as to wipe away toner remaining on the photoconductor 1. The cleaning device 7 is disposed such that an axial center of the fur brush 7*b* is positioned on a center line of the photoconductor 1 in a horizontal direction and the cleaning blade 7*a* is positioned between the charging roller 2 and the fur brush 7*b*.

The cleaning roller shifting unit includes the mechanical assembly (cleaning roller shifting unit) A and a control unit (controller) 20 for controlling the mechanical assembly A.

The cleaning roller shifting unit includes the mechanical assembly (cleaning roller shifting unit) A and a controller 20 for controlling the mechanical assembly A.

The mechanical assembly A includes a bearing 9, a lever 10, a plate cam 11, and a tensile spring 12 as shown in FIG. 2. The bearing 9 has a slot shape and is extendedly provided to a fixed member such as a frame from top down. The shaft 32 of the cleaning roller 3 is loosely inserted into the bearing 9 in a vertically slidable manner. The lever 10 bears the shaft 32 projected from the bearing 9. One end of the lever 10 is rotatably attached to a fixed member such as a frame. The plate cam 11 has a predetermined cam curve and is rotatably provided on an upper side of the other end of the lever 10. The tensile spring 12 energizes the lever 10 towards a peripheral surface of the plate cam 11. The tensile spring 12 is stretched so as to connect an upper point on the lever 10 between the bearing 9 and the plate cam 11 and a fixed member such as a frame positioned above the lever 10.

The plate cam 11 is connected to a solenoid, not shown, rotating to a required angle so as to rotate in a clockwise or counterclockwise direction.

According to the mechanical assembly A configured above, the plate cam 11 rotates (repetitively revolves in a clockwise or counterclockwise direction) around an axle 11*a* as a center such that one end of the lever 10 swings up and down while the other fixed end is a center of rotation, thereby swinging the cleaning roller 3 borne by the lever 10 up and down along the bearing 9. As a result, the cleaning roller 3 directly contacts or separates from the charging roller 2. When the cleaning roller 3 directly contacts the charging roller 2, the cleaning roller 3 presses against the charging roller 2 using only its own weight in order to minimize deformation of the cleaning roller 3.

The controller 20 for controlling operation of the mechanical assembly A includes a predetermined control program and a processor for executing the control program. The processor is comprised of commonly known hardware, including a CPU, a memory, and so forth, and therefore a detailed explanation thereof is omitted herein. A structure of the control program is explained with respect to an operation thereof. For example, the controller 20 operates the mechanical assembly A as described above by controlling the solenoid for driving the plate cam 11 or a motor.

The charging roller 2, the cleaning roller 3, and the mechanical assembly A are assembled as a single integrated unit to form a replaceable process cartridge. The photoconductor 1 or the cleaning device 7 may be included in the above combination as one component. Alternatively, the process cartridge may be formed in an arbitrary combination such as the photoconductor 1 and the charging roller 2, the charging roller 2 and the cleaning device 7, the photoconductor 1 and the cleaning device 7, the photoconductor 1, the charging roller 2 and the cleaning device 7, or the like.

In addition, the process cartridge formed with the above combination has a detection mechanism for the image forming apparatus to determine whether or not the process cartridge is brand-new each time the process cartridge is replaced. As an example, the process cartridge sends an electrical signal to the controller 20, a sensor provided in the image forming apparatus detects the detection mechanism each time the process cartridge is replaced, or a user inputs a signal to the controller 20 by using an operation panel as an information input and output unit of the image forming apparatus. However, the detection mechanism is not limited to the above-described example.

Figure 3:
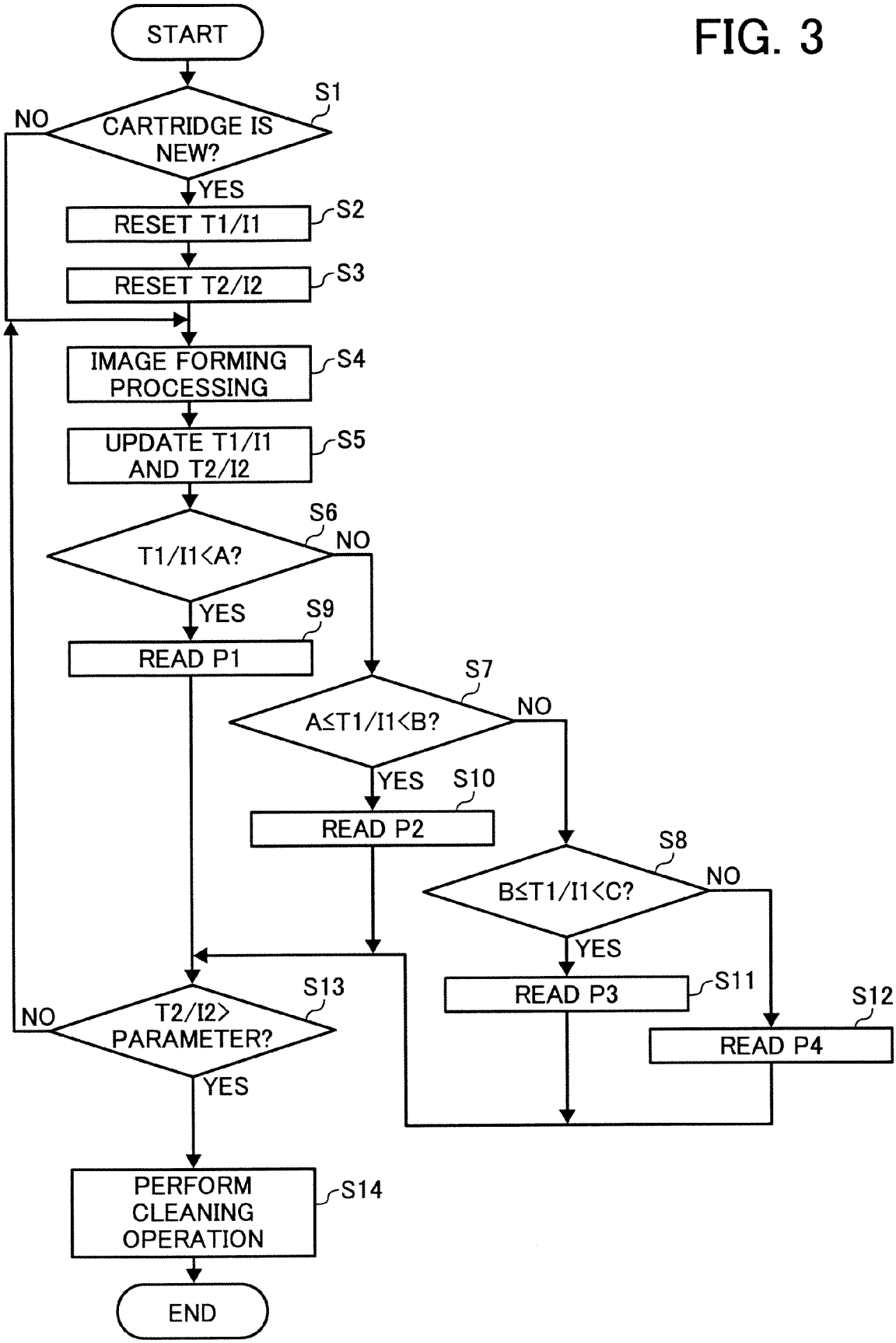
FIG. 3 is a flow chart showing a sequential operation of the image forming apparatus.

Referring to FIG. 3, a description is now given of a sequential operation of the image forming apparatus according to the preferred embodiment described above.

FIG. 3 is a flow chart of the sequential operation of the image forming apparatus.

First, the control program determines whether or not the process cartridge is replaced. For example, as described above, the control program determines whether or not the controller 20 receives an electrical signal from the detection mechanism of the process cartridge or a signal input by a user from the operation panel as the information input and output unit of the image forming apparatus (step S1).

When the process cartridge is replaced with a new cartridge (step S1: Yes), the control program resets a total process cartridge usage time T1 or a total number of image formed sheets I1 recorded in a memory or a counter in the controller 20 since previous replacement of the process cartridge (step S2).

Next, the control program resets a process cartridge usage time T2 or the number of image formed sheets 12 recorded in the memory or the counter in the controller 20 since last cleaning of the charging roller 2 by the cleaning roller 3. In other words, the control program resets a total process cartridge usage time or a total number of image formed sheets since the last cleaning of the charging roller 2 by the cleaning roller 3 as a starting point (step S3).

When the cleaning roller 3 never cleans the charging roller 2 after replacement of the process cartridge, the total process cartridge usage time T1 or the total number of image formed sheets I1 is equal to the process cartridge usage time T2 or the number of image formed sheets 12, respectively. When the cleaning roller 3 cleans the charging roller 2 after even one replacement of the process cartridge, the total process cartridge usage time T1 or the total number of image formed sheets I1 is different from the process cartridge usage time T2 or the number of image formed sheets 12, respectively.

After the processing in step S2 and S3, or when the process cartridge is not replaced with a new cartridge (step S1: No), the control program performs the following processing.

When a user executes image formation (step S4), the control program adds a process cartridge usage time T3 during the image formation or the number of image formed sheets 13 processed by the image formation to the total process cartridge usage time T1 or the total number of image formed sheets I1, respectively. Then, the control program rewrites the total process cartridge usage time T1 or the total number of image formed sheets I1 in the memory or the counter in the controller 20.

Simultaneously, the control program adds the process cartridge usage time T3 during step S4 or the number of image formed sheets 13 processed in step S4 to the process cartridge usage time T2 or the number of image formed sheets 12, respectively, and rewrites the process cartridge usage time T2 or the number of image formed sheets 12 in the memory or the counter in the controller 20 (step S5).

Next, the control program reads a parameter corresponding to the total process cartridge usage time T1 or the total number of image formed sheets I1 from the memory (step S6 to S12: a cleaning timing adjustment unit). The parameter is a predetermined value. Alternatively, a user may input the parameter through the operation panel as the information input and output unit of the image forming apparatus.

The parameter determines a cleaning interval of the charging roller 2. As an example, the parameter determines that the cleaning roller 3 performs a first cleaning of the charging roller 2 when the total number of image formed sheets I1 reaches 5000 since replacement of the process cartridge, a second cleaning when the number of image formed sheets 12 reaches 2000 after the first cleaning, and a third cleaning when the number of image formed sheets 12 reaches 1500 after the second cleaning. Then, after the third cleaning, the cleaning roller 3 performs a cleaning of the charging roller 2 each time the number of image formed sheets 12 reaches 1000 after the previous cleaning, or the like. In the example, the parameter is chosen from four values, 5000 (P1), 2000 (P2), 1500 (P3), and 1000 (P4). Considering deterioration of each member in the image forming apparatus over time, it is appropriate that values of the parameter decrease as the number of cleanings increases as described in the example above. Alternatively, the values of the parameter may be identical.

In FIG. 3, predetermined values A, B, and C are 5000, 7000 (sum of 5000 (P1) as the parameter for the first cleaning and 2000 (P2) as the parameter for the second cleaning), and 8500 (sum of 5000 (P1) as the parameter for the first cleaning, 2000 (P2) as the parameter for the second cleaning, and 1500 (P3) as the parameter for the third cleaning) based on the example above.

In step S6, when the total number of image formed sheets I1 is less than A (5000), the control program chooses 5000 (P1) as the parameter in step S9. Similarly, in step S7, when the total number of image formed sheets I1 is equal to or more than A (5000) and less than B (7000), the control program chooses 2000 (P2) in step S10. In step S8, when the total number of image formed sheets I1 is equal to or more than B (7000) and less than C (8500), the control program chooses 1500 (P3) in step S11. When the total number of image formed sheets I1 is equal to or more than C (8500), the control program chooses 1000 (P4) in step S12.

For example, the present total number of image formed sheets I1 is assumed to be 6100. According to the example above, as 6100 is equal to or more than 5000 and less than 7000 (that is, $A \leqq I1 < B$ in step S7), the control program chooses 2000 (P2) as the parameter in step S10.

Then, the control program compares the process cartridge usage time T2 or the number of image formed sheets I2 since the last cleaning of the charging roller 2 by the cleaning roller 3 with the parameter read from the memory (step S13). According to the example above, as the present total number of image formed sheets I1 is 6100, the cleaning roller 3 has already performed the first cleaning. Thus, the number of image formed sheets I2 since the first cleaning is 1100, and the control program compares 1100 with 2000 (P2) as the parameter.

In step S13, when the process cartridge usage time T2 or the number of image formed sheets I2 is equal to or less than the parameter read from the memory (step S13: No), the cleaning roller 3 does not clean the charging roller 2, and a user may execute image formation. On the other hand, when the process cartridge usage time T2 or the number of image formed sheets I2 is more than the parameter (step S13: Yes), the cleaning roller 3 promptly cleans the charging roller 2.

More specifically, the solenoid, not shown, rotates to a required angle, and thereby the cleaning roller 3 moves down via the lever 10 and the bearing 9 and contacts the charging roller 2. Then, the cleaning roller 3 collects foreign material such as toner remaining on a peripheral surface of the charging roller 2 by using the melamine resin foam 31 while following rotation of the charging roller 2.

After a predetermined time, the solenoid, not shown, rotates to a required angle, and thereby the cleaning roller 3 moves up via the lever 10 and the bearing 9 and separates from the charging roller 2 to complete the sequential cleaning operation (step S14).

As for an operation state of the image forming apparatus when the controller 20 causes the cleaning roller to contact the charging roller 2, a time when the charging roller 2 still rotates right after the image forming apparatus finishes image formation (a non-operation state of the image forming apparatus) is desirable. On the other hand, it is desirable that the controller 20 causes the cleaning roller 3 to separate from the charging roller 2 while the image forming apparatus performs image formation.

The inventors of the present invention have found through experiments that a required time for the cleaning roller 3 to sufficiently clean the charging roller 2 is approximate 10 to 20 sec.

As described above, the image forming apparatus according to the preferred embodiment includes the cleaning roller shifting unit for causing the cleaning roller 3 to contact the charging roller 2 for the required time every predetermined number of image formed sheets or every predetermined time for image formation. Therefore, the image forming apparatus may quite efficiently use the cleaning roller 3 without shortening a life of the cleaning roller 3. In addition, the cleaning roller shifting unit does not cause the cleaning roller 3 to contact the charging roller 2 when the charging roller 2 does not require cleaning. Therefore, the image forming apparatus may eliminate wasteful use of the cleaning roller 3.

It should be noted that the above-described embodiments are merely illustrative, and numerous additional modifications and variations are possible in light of the above teachings. For example, elements and/or features of different illustrative and preferred embodiments herein may be combined with each other and/or substituted for each other within the scope of this disclosure. It is therefore to be understood that the disclosure of this patent specification may be practiced otherwise than as specifically described herein.

What is claimed is:

1. A process cartridge, comprising:

a charging roller configured to continuously rotate and uniformly charge a photoconductor for forming an electrostatic latent image thereon;

a cleaning roller configured to contact a peripheral surface of the charging roller and clean the charging roller while being driven by rotation of the charging roller, wherein a peripheral surface of the cleaning roller is formed of a melamine resin foam; and a cleaning roller shifting unit configured to cause the cleaning roller to contact the charging roller for a predetermined time at predetermined intervals of image formation while holding the cleaning roller in a movable manner.

2. The process cartridge according to claim 1, wherein the cleaning roller shifting unit is configured to cause the cleaning roller to contact the charging roller at the predetermined intervals of image formation, which are determined based on a predetermined number of image formations or a predetermined elapsed time for image formation.

3. The process cartridge according to claim 1, wherein the cleaning roller shifting unit separates the cleaning roller from the charging roller during an operation of image formation and contacts the cleaning roller with the charging roller during a non-operation of image formation.

4. The process cartridge according to claim 1, wherein the cleaning roller shifting unit includes a cleaning timing adjustment unit configured to adjust the predetermined intervals of image formation.

5. The process cartridge according to claim 1, wherein the charging roller and the photoconductor are arranged such that an infinitesimal space is formed between the charging roller and the photoconductor.

6. The process cartridge as claimed in claim 1, wherein the cleaning roller shifting unit comprises a mechanical assembly and a controller, the mechanical assembly comprising a slot configured to guide a rotation shaft of the cleaning roller, a lever configured to support the rotation shaft, and a cam causing the lever to move.

7. An image forming apparatus, comprising:

a charging roller configured to continuously rotate and uniformly charge a photoconductor for forming an electrostatic latent image thereon;

a cleaning roller configured to contact a peripheral surface of the charging roller and clean the charging roller while being driven by rotation of the charging roller, wherein a peripheral surface of the cleaning roller is formed of a melamine resin foam; and a cleaning roller shifting unit configured to contact the cleaning roller with the charging roller for a predetermined time at predetermined intervals of image formation while holding the cleaning roller in a movable manner.

8. The image forming apparatus according to claim 7, wherein the cleaning roller shifting unit is configured to cause the cleaning roller to contact the charging roller at the predetermined intervals of image formation, which are determined based on a predetermined number of image formations or a predetermined elapsed time for image formation.

9. The image forming apparatus according to claim 7, wherein the cleaning roller shifting unit separates the cleaning roller from the charging roller during an operation of image formation and contacts the cleaning roller with the charging roller during a non-operation of image formation.

10. The image forming apparatus according to claim 7, wherein the cleaning roller shifting unit includes a cleaning timing adjustment unit configured to adjust the predetermined intervals of image formation.

11. The image forming apparatus according to claim 7, wherein the charging roller and the photoconductor are arranged such that an infinitesimal space is formed between the charging roller and the photoconductor.

12. The image forming apparatus as claimed in claim 7, wherein the cleaning roller shifting unit comprises a mechanical assembly and a controller, the mechanical assembly comprising a slot configured to guide a rotation shaft of the cleaning roller, a lever configured to support the rotation shaft, and a cam causing the lever to move.

13. A charging device, comprising:

a charging roller configured to continuously rotate and uniformly charge a photoconductor to form an electrostatic latent image thereon;

a cleaning roller configured to contact a peripheral surface of the charging roller and to clean the charging roller while being driven by rotation of the charging roller; and a cleaning roller shifting unit configured to cause the cleaning roller to contact the charging roller for a predetermined time at predetermined intervals of image formation while holding the cleaning roller in a movable manner.

14. The charging device according to claim 13, wherein the cleaning roller shifting unit is configured to cause the cleaning roller to contact the charging roll at the predetermined intervals of image formation, which are determined based on a predetermined number of image formations or a predetermined elapsed time for image formation.

15. The charging device according to claim 13, wherein the cleaning roller shifting unit is configured to separate the cleaning roller from the charging roller during an operation of image formation and to contact the cleaning roller with the charging roller during a non-operation of image formation.

16. The charging device according to claim 13, wherein the cleaning roller shifting unit includes a cleaning timing adjustment unit configured to adjust the predetermined intervals of image formation.

17. The charging device according to claim 13, wherein the charging roller and the photoconductor are arranged such that an infinitesimal space is formed between the charging roller and the photoconductor.

18. The charging device according to claim 13, wherein the cleaning roller shifting unit comprises a mechanical assembly and a controller, the mechanical assembly including a slot to guide a rotation shaft of the cleaning roller, a lever to support the rotation shaft, and a cam causing the lever to move.

* * * * *